US006409525B1

(12) United States Patent
Hoelscher et al.

(10) Patent No.: US 6,409,525 B1
(45) Date of Patent: Jun. 25, 2002

(54) TERMINAL POSITION HOUSING ASSEMBLY

(75) Inventors: Wolfgang Hoelscher, Stokesdale; Paul P. Siwinski, Clemmons; Bobby G. Ward, King, all of NC (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 09/734,088

(22) Filed: Dec. 11, 2000

(51) Int. Cl.[7] ..... H01R 13/44
(52) U.S. Cl. ..... 439/140; 439/141; 439/378
(58) Field of Search ..... 439/374, 140, 439/364, 141, 378, 955

(56) References Cited

U.S. PATENT DOCUMENTS

| | | | | |
|---|---|---|---|---|
| 4,077,694 A | | 3/1978 | Cobaugh et al. | |
| 4,220,383 A | * | 9/1980 | Scheingold et al. | |
| 4,797,116 A | | 1/1989 | Isohata et al. | 439/141 |
| 4,832,613 A | | 5/1989 | Tsukakoshi | 439/141 |
| 4,874,318 A | * | 10/1989 | Spencer | 439/71 |
| 5,068,601 A | * | 11/1991 | Parmenter | 324/158 |
| 5,071,369 A | | 12/1991 | Denlinger et al. | 439/595 |
| 5,207,587 A | * | 5/1993 | Hamill et al. | 439/76 |
| 5,501,606 A | | 3/1996 | Oda et al. | 439/140 |
| 5,533,909 A | * | 7/1996 | Endo et al. | 439/381 |
| 5,558,526 A | | 9/1996 | Nagamine | 439/140 |
| 5,743,756 A | | 4/1998 | Hasz et al. | 439/364 |
| 5,868,583 A | * | 2/1999 | Naitou et al. | 439/76.2 |
| 5,879,174 A | | 3/1999 | Kountz et al. | 439/141 |
| 5,888,089 A | * | 3/1999 | Konoya et al. | 439/404 |
| 5,993,255 A | | 11/1999 | Yurko | 439/595 |
| 6,004,158 A | | 12/1999 | Ward | 439/595 |
| 6,171,133 B1 | * | 1/2001 | Altuner et al. | 439/381 |
| 6,257,918 B1 | * | 7/2001 | Yamamoto | 439/364 |

* cited by examiner

*Primary Examiner*—Khiem Nguyen
*Assistant Examiner*—Hae Moon Hyeon

(57) ABSTRACT

A terminal position housing (34, 134) is used with an alignment plate (42, 142) to align male terminals or blades (12, 112) extending from a printed circuit board assembly (6, 106). A plug connector (14, 114) having multiple female terminals or receptacles (16, 116) is mated to the blades (12, 112) with the assistance of the terminal position housing (34, 134) and the alignment plate (42, 142). The terminal position housing (34, 134) includes a stationary plate (36, 136) having apertures (38, 138) through which the blades (12, 112) are inserted. The stationary plate apertures (38, 138) are aligned with apertures (44, 144) in the movable alignment plate (42, 142), and these aligned apertures keep the blades (12, 112) aligned with the receptacles (16, 116) even if the blades (12, 112) may be deflected due to forces applied by mechanical assist members, such as bolts (96).

29 Claims, 13 Drawing Sheets

FIG 5
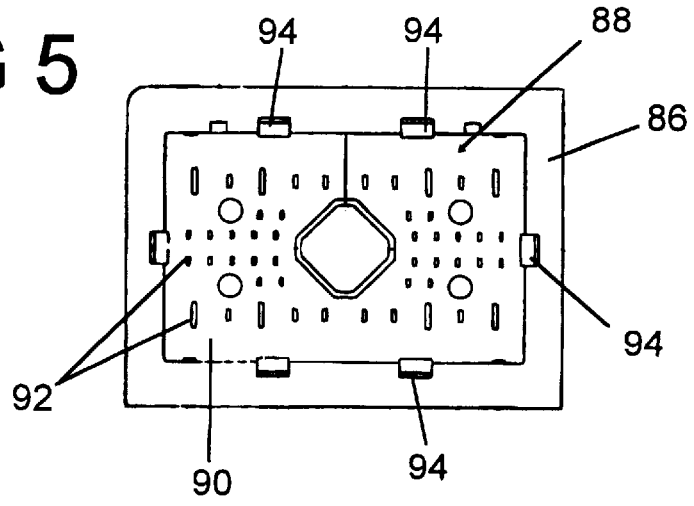
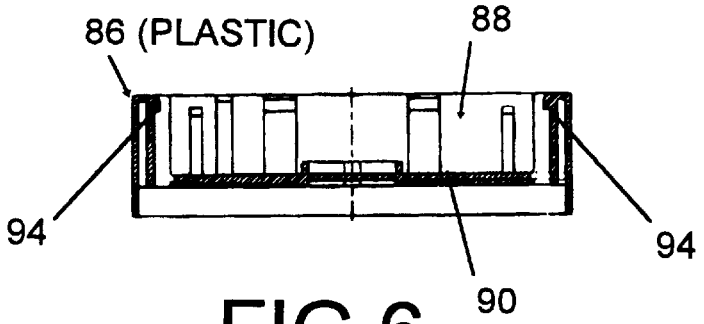
FIG 6
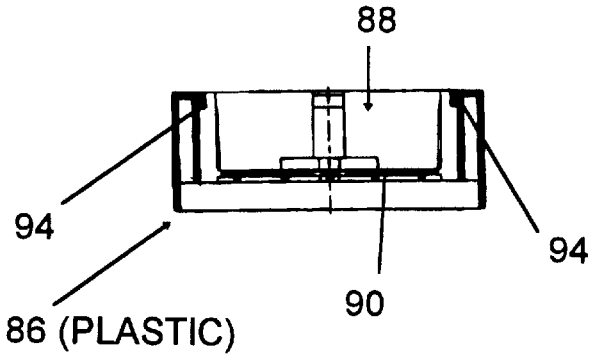
FIG 7

TERMINAL POSITION HOUSING ASSEMBLY

BACKGROUND OF THE INVENTION

1. Field of the Invention

This invention is related to electrical connectors and to an assembly for facilitating the connection of an electrical plug connector to terminals on a printed circuit board. More particularly this invention is related to the alignment of printed circuit board terminals for reliable connection to multicontact electrical connectors.

2. Description of the Prior Art

Electronic components in automobiles and motor vehicles are commonly housed in separate modules or subassemblies. Typically the electronic components are mounted on printed circuit boards, and separate modules are connected by a wiring harness that includes a number of individual wires. The modules, such as junction boxes or power distribution modules, generally have pins or blades soldered to the printed circuit board and mounted in a header so that the male pins or blades can be connected to a plug connector having mating receptacle or female contacts or terminals. Often a large number of terminals or contacts are mounted in the same header, and the mating forces can be quite high. Mechanical assist means, such as cams and bolts, are often used to overcome these forces. In addition to the normal difficulty of aligning a large number of male and female terminals during mating, the mechanical forces needed to assist mating can also flex or deform the housing or header and deflect the printed circuit board terminals resulting in even greater misalignment. For example, in a prior art power distribution center in which the wiring harness is connected by using a bolt, forces applied to the bolt can deflect the bulkhead, behind which the printed circuit board is located, and this movement of the bulkhead can then deflect terminal pins extending through apertures in the bulkhead.

For prior art wire to wire connectors, pin alignment problems have been addressed by employing a movable alignment plate to lead the male terminals into engagement with mating female terminals. Examples of such connectors are shown in U.S. Pat. No. 5,501,606 and U.S. Pat. No. 6,004,158. The alignment plates in the bolt actuated connectors described in those patents have been used to assist mating between male and female terminals that are latched into mating plug and receptacle housings. The terminals in both mating connectors shown in those patents are free to move laterally to a limited extent, and the alignment plates provide adequate lateral alignment to insure that the leading ends of the male terminals are aligned with housing cavity entrance and the female contact lead in of the mating electrical connector.

U.S. Pat. No. 5,501,606 does show a prior art connector in which a movable alignment plate is used in a right angle printed circuit board header. However, the right angle male pin terminals do not appear to be latched in the header housing, and only the plate functions to correct any misalignment of the male terminal leading ends during mating.

SUMMARY OF THE INVENTION

This invention is an apparatus or terminal position housing assembly that can be used to align a plurality of male terminals, which may extend from a printed circuit board, with female terminals in an electrical connector as the electrical connector is mated to the printed circuit board. The apparatus includes a stationary plate with a plurality of apertures or holes extending through the stationary plate. These apertures are dimensioned to permit insertion of male terminals through the apertures and the apertures will laterally align the terminals or blades. The apparatus also includes an alignment plate that is shiftable toward the stationary plate and moves along the male terminals or blades. The alignment plate includes second apertures dimensioned to permit insertion of male terminals or blades through the alignment plate. The alignment plate is constrained, relative to the stationary plate, so that the male terminals are progressively aligned as the male terminal are first inserted through the first apertures and then through the second apertures. The alignment plate is held in an extended position as part of the terminal position housing assembly as the male terminals are inserted through the two spaced aligning apertures.

In the preferred embodiments shown herein, the stationary plate and the alignment plate are positioned over the printed circuit board terminals after the printed circuit board terminals have been attached to a printed circuit board. The alignment plate is located in cavity in a housing that includes the stationary plate. Both the stationary plate and the alignment plate are spaced from the base of the printed circuit board terminals and from the printed circuit board, so that the stationary plate and the alignment plate move any misaligned terminals more closely into a position where they will mate with female terminals in the mating connector. The terminal position housing and the alignment plate are also suitable for use with a plug connector that uses a mechanical assist member, such as a bolt, to overcome the mating forces when a large number of printed circuit board blades or terminals are mated with a large number of female or receptacle terminals in a mating plug connector. This terminal position housing assembly is suitable for use with bulkhead mounted electronic modules, with junction boxes or with power distribution centers used in automobiles and motor vehicles. The stationary plate and the movable alignment plate can also be used with the terminals positioned in an array and are not limited to use with a printed circuit board and terminals soldered or attached to the printed circuit board.

BRIEF DESCRIPTION OF THE DRAWINGS

FIGS. 1–10 show a first embodiment of this invention.

FIG. 1 is a three dimensional view of a plug connector assembly that can be mated to the terminal position housing assembly shown in FIG. 2.

FIG. 2 is a three dimensional view of a terminal position housing assembly comprising a housing and a shiftable alignment plate that can be mated to the plug connector shown in FIG. 1.

FIG. 3 is a sectional view showing the terminal position housing assembly shown in FIG. 2 positioned on a printed circuit board assembly that is located within a bulkhead that is suitable for use in an automotive power distribution center or a junction box. FIG. 3 shows the relative positions of the alignment plate and the housing when the male terminals are inserted into the terminal position housing.

FIG. 4 is a sectional view showing the plug connector of FIG. 2 mated with the terminal position housing of FIG. 2 as positioned on a printed circuit board assembly.

FIG. 5 is a top view of a bulkhead interface flange on which the terminal position housing assembly of FIG. 2 can be mounted.

FIG. 6 is a side sectional view of the bulkhead interface flange of FIG. 5.

FIG. 7 is an end sectional view of the bulkhead interface flange of FIG. 5.

FIG. 8 is a top view of the terminal position housing shown in FIG. 2.

FIG. 9 is a view of the mating face of the plug connector of FIG. 1.

FIG. 10 is an exploded partial section view illustrating the manner in which a male printed circuit board terminal or blade is progressively aligned by the bulkhead interface, the terminal position housing and the alignment plate.

FIG. 11 is a three dimensional view of a terminal position housing.

FIG. 12 is a section view of the terminal position housing shown in FIG. 11.

FIG. 13 is a three dimensional view of an alignment plate that can be used with the terminal position housing of FIG. 11 as part of a terminal position housing assembly.

FIG. 14 is a top view of the alignment plate shown in FIG. 13.

FIG. 15 is a sectional view of the alignment plate shown in FIG. 13.

FIG. 16 is a sectional view of a terminal position housing assembly mounted on a printed circuit board positioned behind a bulkhead, wall or cover.

FIG. 17 is a sectional view showing a plug connector mated with the terminal position housing assembly of FIG. 16.

DETAILED DESCRIPTION OF THE PREFERRED EMBODIMENTS

Figure 1:
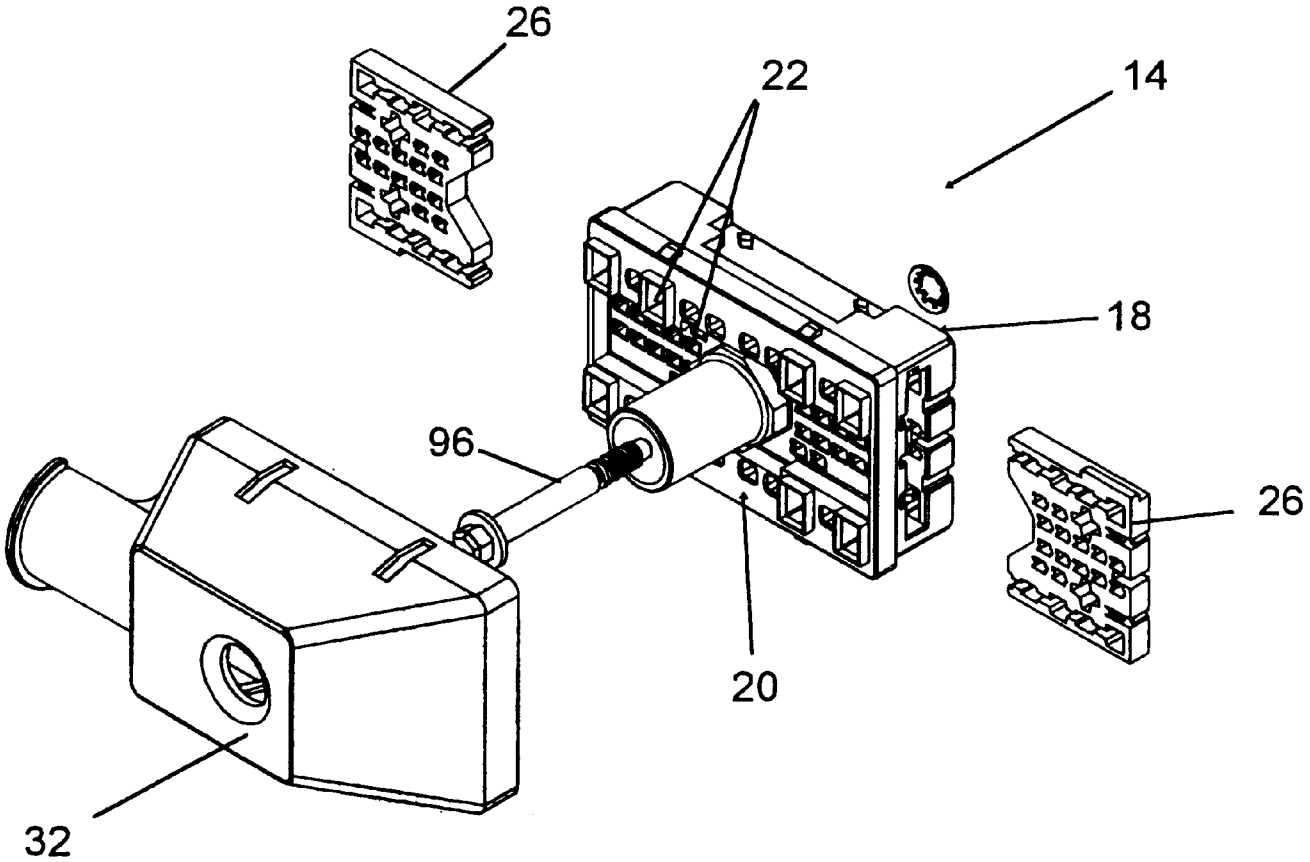
Figure 2:
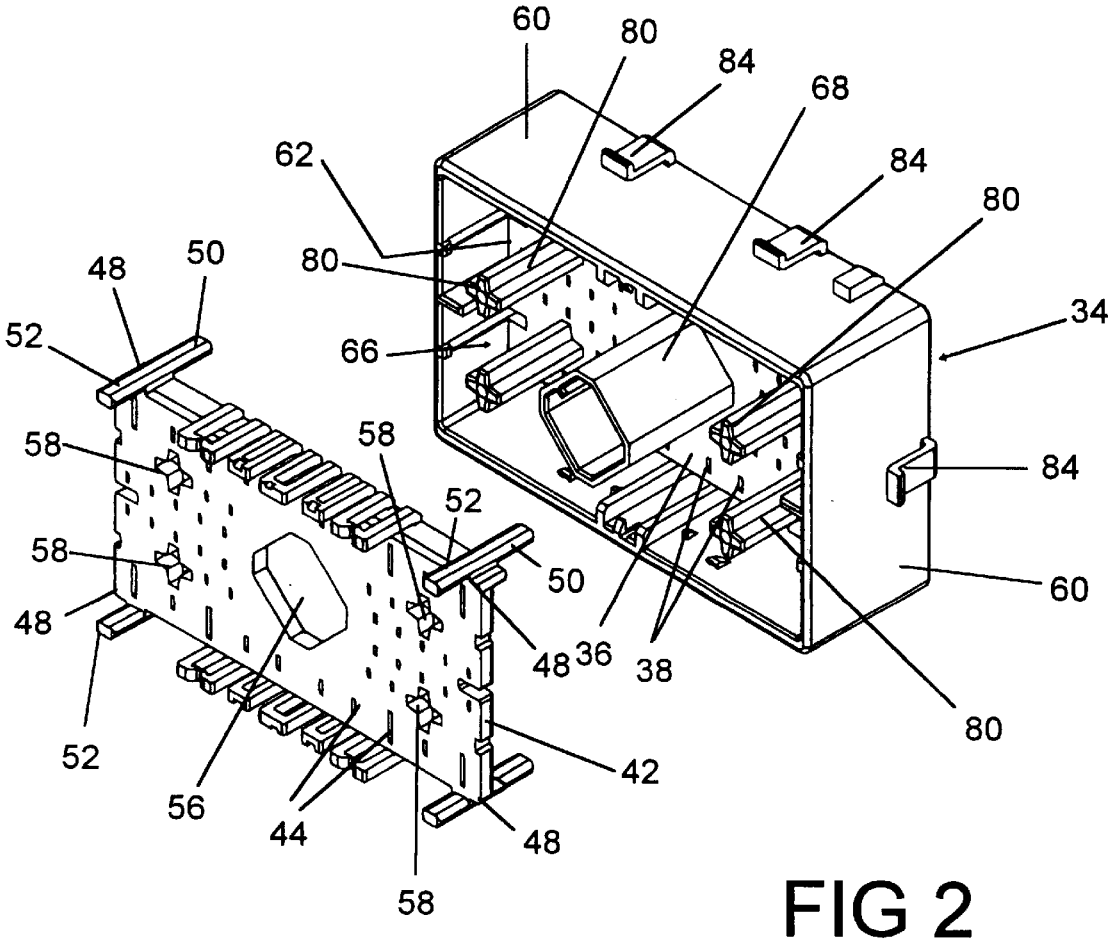

FIGS. 1–10 show a first embodiment of a terminal position housing assembly and a plug connector used therewith to connector wires in a harness terminated to the plug connector 14 to male printed circuit board terminals or blades 12 extending from a printed circuit board assembly 6. The blades 12 need not all be the same size, and in most applications, more than one size blade will be used on the same printed circuit board assembly 6. In this embodiment, the printed circuit board assembly 6 includes two printed circuit boards 8 and 10 that are positioned behind a bulkhead, wall, or box cover 2. The blades extend through an opening 4 in the bulkhead and are accessible for mating with receptacle terminals 16 in the multicontact plug connector 14. Printed circuit board assemblies of this type are typically found in power distribution centers and junction boxes or other electronic modules found in automobiles and other motor vehicles. FIGS. 11–17 show another embodiment that can be used for similar applications. This second embodiment depicts another method of mounting the terminal position housing on a printed circuit board assembly and a bulkhead.

Each of these embodiments position and maintain alignment between blades 12 and corresponding receptacle terminals 16 so that a plug connector 14 can be mated to the printed circuit board assembly. In each case the terminal position housing and the alignment plate is mounted on the printed circuit board assembly, or the electronic component or bulkhead with which the printed circuit board assembly is associated, by inserting an array of blade terminals, previously attached or soldered to a printed circuit board into aligned apertures in the terminal position housing and a movable alignment plate. When a mechanical assist, such as a bolt and associated threaded nut, is required to mate the plug connector to the printed circuit board assembly, the terminal position housing and the movable alignment plate keep the blades, and especially the tips of the blades, in proper position so that they can be mated with corresponding receptacle terminals in a predefined pattern, even if the mechanical forces applied for mating might otherwise tend to distort the bulkhead, the printed circuit board or the blades themselves.

Figure 4:
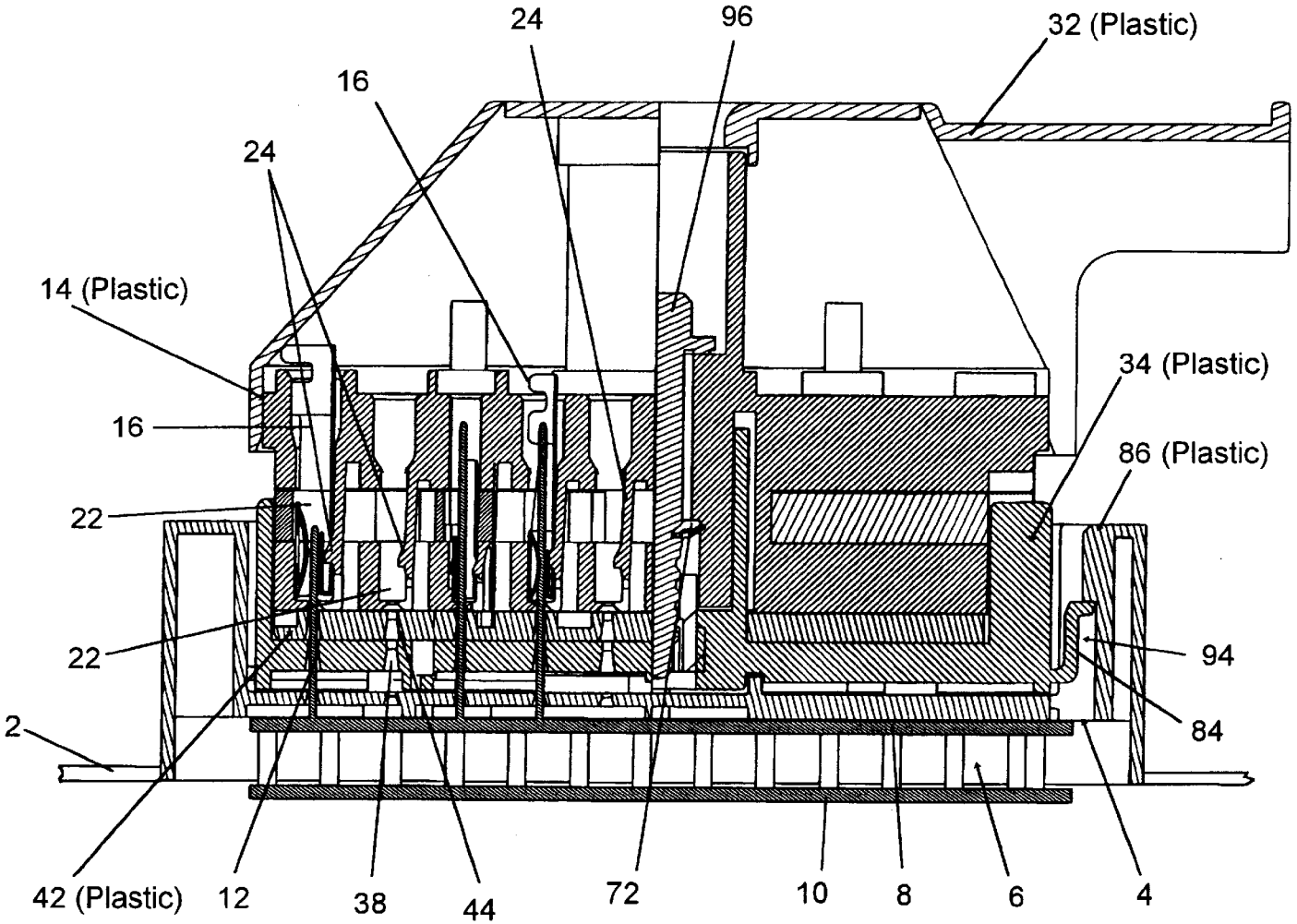
Figure 8:
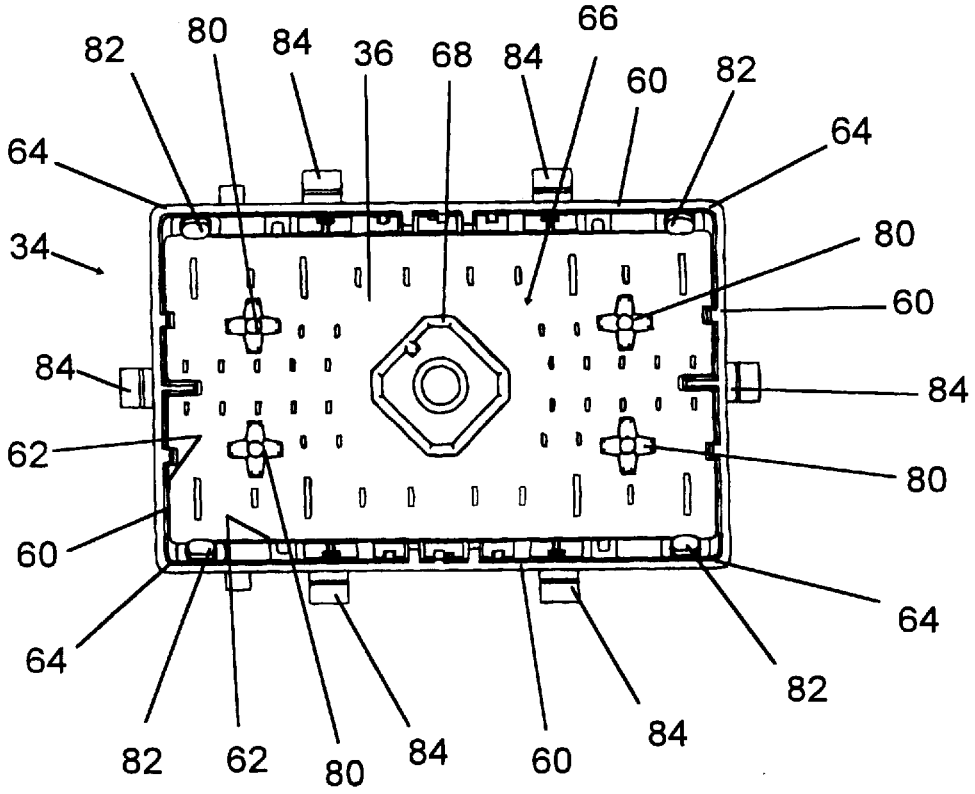
Figure 9:
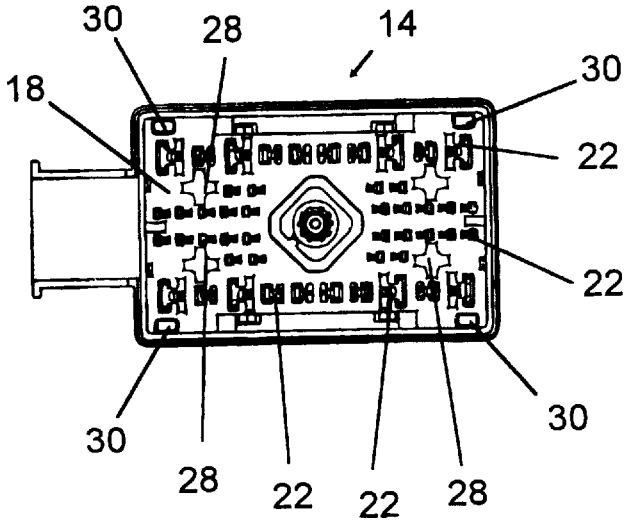

A plug connector 14, shown in FIG. 1 and FIG. 4, includes receptacle or female contacts or mating terminals 16 located in terminal cavities 22 that extend between a plug mating face 18 and a plug rear face. These terminals 16 are generally conventional in configuration and are intended to be crimped or terminated to wires in a harness (not shown) that will extend out the rear of the connector. Resilient housing latches 24 secure the terminal 16 in the housing cavities 22 and secondary locks 26 can be inserted from the sides. A wire cover 32 is mounted on the rear of the plug connector 14. A bolt 96 is accessible through the wire cover 32 and the threaded portion of the bolt extends beyond the plug mating face 18 where it can engage a companion threaded member in the terminal position housing 34 to which the plug connector 14 will be mated.

Figure 3:
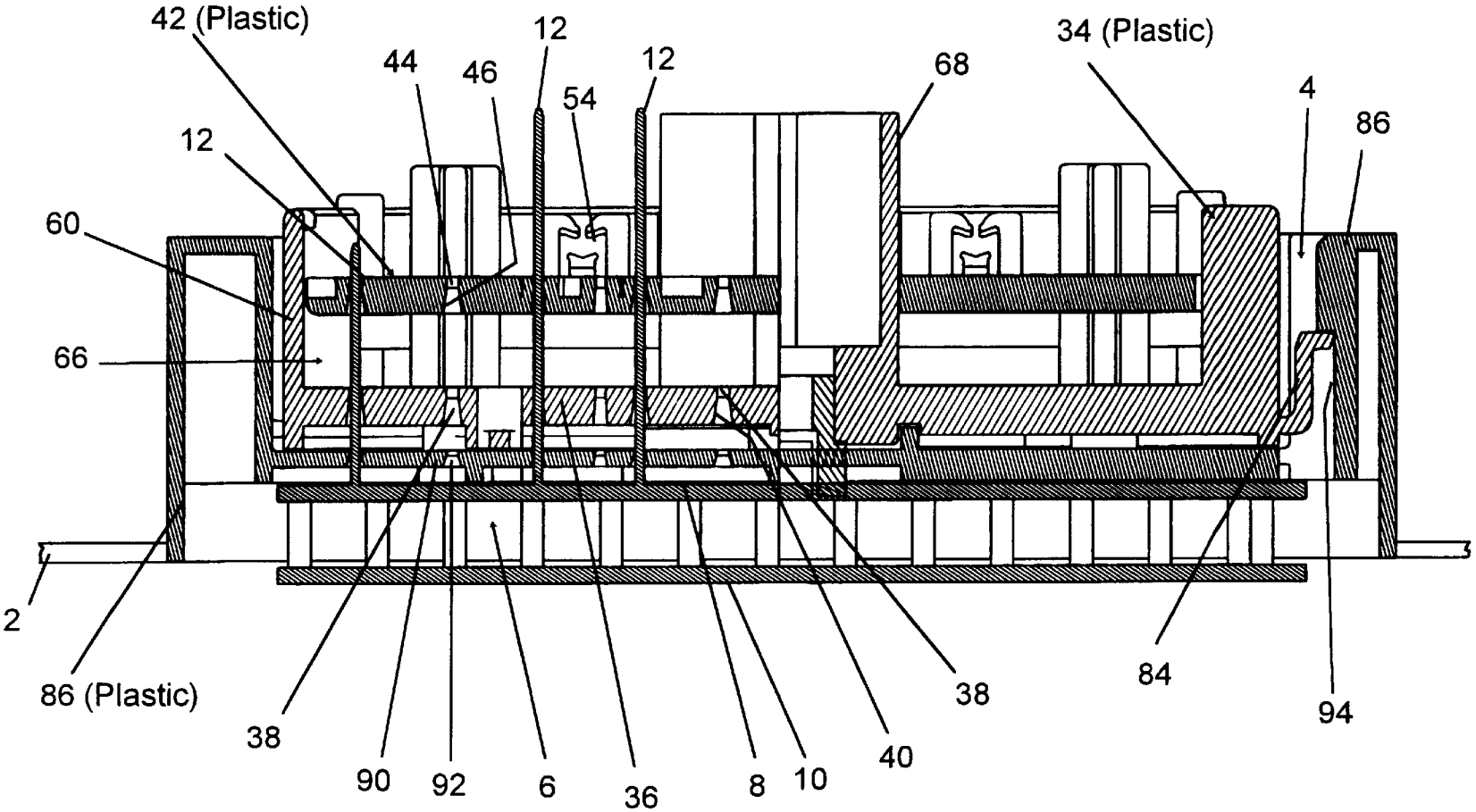

In the first embodiment, a terminal position housing 34 and a movable alignment or guide plate 42 form a terminal position housing assembly that can be used to align male printed circuit board terminals or blades 12 during mating with a plug connector 14. The terminal position housing 34 has a base or stationary plate 36 with a plurality of apertures 38 located in an array that corresponds to the location of the terminals or blades 12 that have been previously soldered to or mounted on one of the two printed circuit boards 8, 10 that form the printed circuit board assembly 6 as shown in FIG. 3. The alignment plate 42 also has a plurality of apertures 44 that are also located in an array conforming to the positions of the blades 12. The first stationary plate apertures 38 and the second alignment plate apertures 44 are therefore mutually in alignment, and when the blades 12 are inserted first into the first arrays of apertures and then into the second array of apertures with the alignment plate held in a position spaced from the stationary plate, the blades are progressively aligned so that the ends of the blades 12 win be initially properly positioned to mate with female receptacle terminals 16 in the plug connector 14. The stationary plate 36 and the alignment plate 42 will also keep the blades 12 properly aligned or positioned during mating of the blades 12 with the receptacle terminals 16, even in the presence of high mating forces, or mechanical assist devices that may tend to deform or flex the bulkhead 2.

Figure 10:
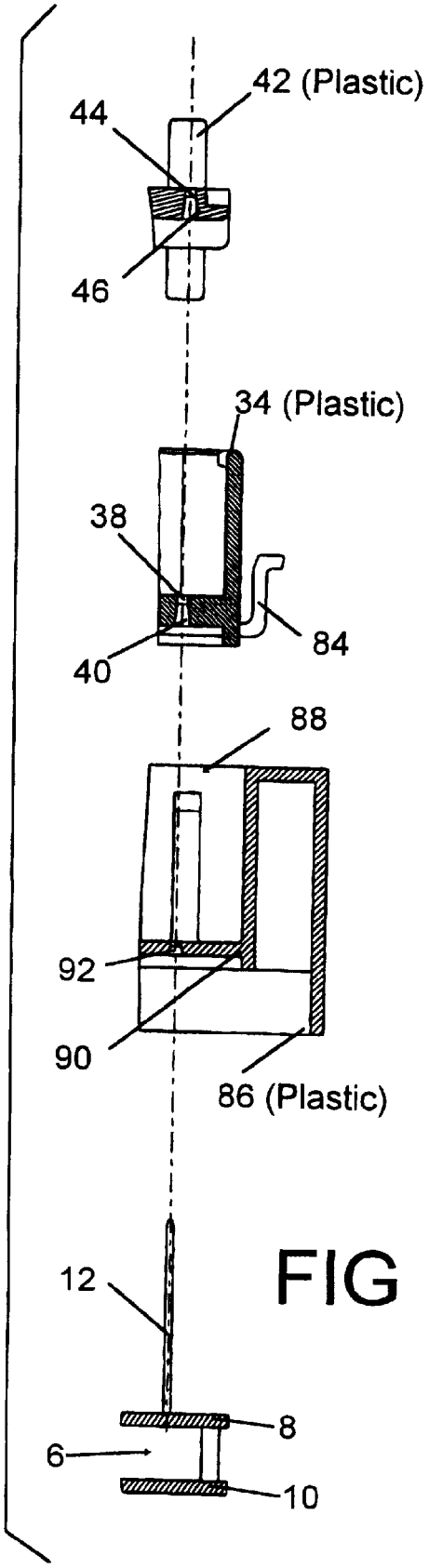

The alignment plate 42 is a molded plastic member having a rectangular shape so that the alignment plate 42 can fit within a rectangular cavity 66 formed on the mating face of the terminal position housing 34. Each of the apertures 44, through which a blade terminal 12 can be inserted, has a generally rectangular configuration and extends between the opposite surfaces of the generally flat plate. Apertures 44 have a tapered lead 46 in as shown in FIGS. 3 and 10 so that the tip of a blade 12 can be gathered into the aperture 44.

Guide posts 50 and 52 extend in opposite directions at the corners 48 of the alignment plate 42. The bottom guide posts 50 comprise a primary guiding means for maintaining proper alignment between the alignment plate aperture 44 and the stationary plate apertures 38 as the alignment plate 42 moves relative to the housing 34 and to the printed circuit boards 8, 10 during mating of the plug connector 14 to the printed circuit board blades 12. The top guide posts 52 comprise secondary guiding means and are received within openings of the mating face of plug connector 14 during mating so that the alignment plate remains properly oriented and constrained against relative lateral movement as it moves from an initial contact alignment position shown in FIGS. 3 to a fully mated position shown in FIG. 4.

The alignment plate 42 also includes latching arms 54 that retain the alignment plate in an initial, extended or premating position as shown in FIG. 3. These latching arms 54 are disengaged from the terminal housing 34 when the as the plug connector 14 is mated to the printed circuit board assembly 6. The manner in which these latching arms function is described in more detail in U.S. Pat. No. 5,501,606, which is incorporated herein by reference. The alignment plate also abuts a surface on the terminal position housing 34 to hold the alignment plate 42 in the extended position, shown in FIG. 3 as the terminal position housing assembly is mounted on the printed circuit board assembly 6 by inserting the array blades 12 initially into the array of first apertures 38 in the stationary plate 36 and then into the second array of apertures 44 in the alignment plate 42.

In addition to the apertures 44, the alignment plate 42 also has a central opening 56 that is dimensioned to receive a silo 68 on the terminal position housing 34 Four alignment post openings 58 having a cruciform shape are located in four quadrants flanking the central silo opening 56. These alignment post openings 58 are dimensioned to receive alignment posts 80 located on the terminal position housing 34 that are intended to align the plug connector 14 with the terminal position housing assembly and the printed circuit board blades 12, in a manner to be subsequently discussed.

Terminal position housing 34 is a one-piece molded plastic member having a base in the form of a stationary plate 36 with four outer peripheral walls 60 extending upwardly from plate edges 62 to form a shroud surrounding a cavity 66. The alignment plate 42 is positioned in the cavity 66 and can shift from an extended position shown in FIG. 3 to a fully mated configuration shown in FIG. 4. This terminal position housing 34 is thus in the form of a shrouded header without any contacts or terminals 12 mounted in the housing. The array of apertures 38 in the stationary plate 36 are dimensioned to permit insertion of terminal blades 12 when the terminal position housing is mounted on the bulkhead 2 or the printed circuit board assembly 6, but the terminals 12 are not secured in the apertures 38, although the sides of the apertures 38 do restrict lateral movement of the blades 12, and thus serve to align the blades 12.

Guide post openings 82 are located adjacent the corners 64 of the stationary base plate 36. These openings are in alignment with the lower guide posts 50 on the alignment plate and serve not only to permit movement of the alignment plate 42 into its fully mated configuration as shown in FIG. 4, but also to insure that the alignment plate 42 does not cock or become misaligned during this movement. Second apertures 44 thus remain aligned with first apertures 38.

In addition to the outer walls 60, other structures project upwardly from the stationary base or plate 36 of the terminal position housing 34. Four alignment posts 80, each having a cruciform configuration, extend upwardly beyond the upper edges of the walls 60. These alignment posts 80 extend upwardly through similarly shaped openings 58 in the alignment plate 42. In turn these alignment posts 80 are received within alignment post openings 28 in the plug connector 14 to guide or align the plug connector 14 with the terminal position housing 34 and the terminal blades 12 during mating.

A silo 68 in the form of a continuous thin wall extends upwardly from the stationary plate or base 36. This silo is open on the interior and forms a space for receipt of a mating assist bolt 96 retained on the plug connector 14. A fastener in the form of a female threaded member 72, such as a nut or a ring with an inner edge serving to engage the bolt 96 is positioned within the silo 68. When the fastening bolt 96 engages the fastener or nut 72, rotation of the bolt 96 brings the plug connector 14 into full engagement with the terminal blades 12 overcoming a force resisting mating. In some prior art bolt actuated bulkhead connector assemblies this force applied at a central location has caused deformation of a bulkhead or wall. When a wall or bulkhead is deformed in this manner, the terminals extending through the bulkhead can also be laterally displaced as the bulkhead flexes so that such printed circuit board terminals are no longer aligned with the receptacle terminals with which they are mated.

The terminal position housing 34 in the embodiment of FIGS. 1–10 is mounted to a bulkhead 2 by latching the terminal position housing 34 to a flange interface 86. This bulkhead flange as shown in FIGS. 5–7 is rectangular and forms a rectangular central compartment 88 in which the terminal position housing 34 is inserted. Molded flexible snap latches 84 extend from the sides of the housing 34 and these latches 84 will snap into latch openings 94 in the flange 86 to secure the housing 34 to the bulkhead 2. Since the bolt 96 engages a nut 72 in the terminal housing 34, the force applied by tightening the bolt is not transferred to the bulkhead at only this central location. Instead this force is transferred through the flange 86 and the force is distributed around the flange by the multiple snap latches 84. The flange 86 is part of the bulkhead 2. By latching the terminal position housing 34 to the bulkhead 2, instead of attaching it directly to the printed circuit board assembly 6, potentially valuable printed circuit board real estate need not be dedicated to latching.

The flange interface base 90 has an array of base terminal apertures 92 that are dimensioned to receive the printed circuit board blades 12 when printed circuit board assembly 6 is mounted to or within the bulkhead 2. As illustrated in FIG. 10, the base apertures 92 can serve to initially align the blades 12. Then the apertures 38 in the terminal position housing 34 serve to even more precisely align the terminal blades 12. Finally, the apertures 44 in the alignment plate 42 serve to even more closely align the terminal blades with the true position corresponding to the location of the receptacle contacts 16 in the plug connector 14. Thus each terminal blade 12 is progressively aligned by the apertures 92, 38 and 44 so that the true position tolerance becomes less with each tapered aperture. In this way the tips of the blades 12 are more precisely aligned than the lower end of the blades. The position of the blade tip will be more accurate when it extends through the alignment plate apertures then when it initially passed through the apertures in the stationary plate, but the stationary plate helps align the blades for entry into the alignment plate apertures. This alignment is especially significant when relatively stiff terminal blades 12 are employed, because such stiff blades will have less tendency to float during mating. Where mating terminals in two mating connectors both can float laterally, alignment problems are not as difficult to overcome.

FIGS. 11–17 show a second embodiment of the terminal position housing assembly in which the terminal position housing 134 is bolted directly to the printed circuit board assembly 106 instead of being latched to a flange as in the embodiment of FIGS. 1–10.

Figure 11:
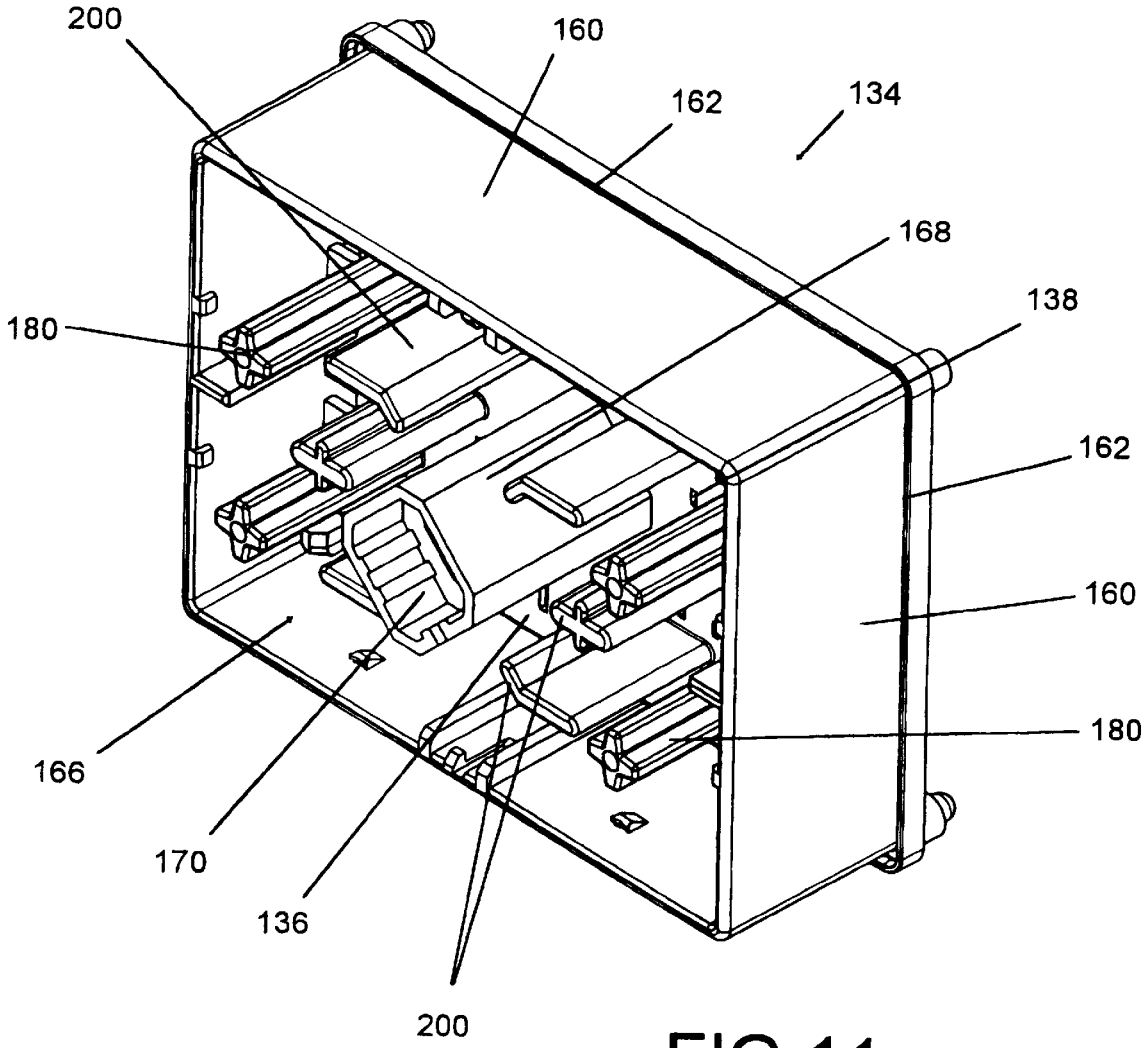
FIGS. 11–17 are views illustrating a second embodiment of this invention.
Figure 12:
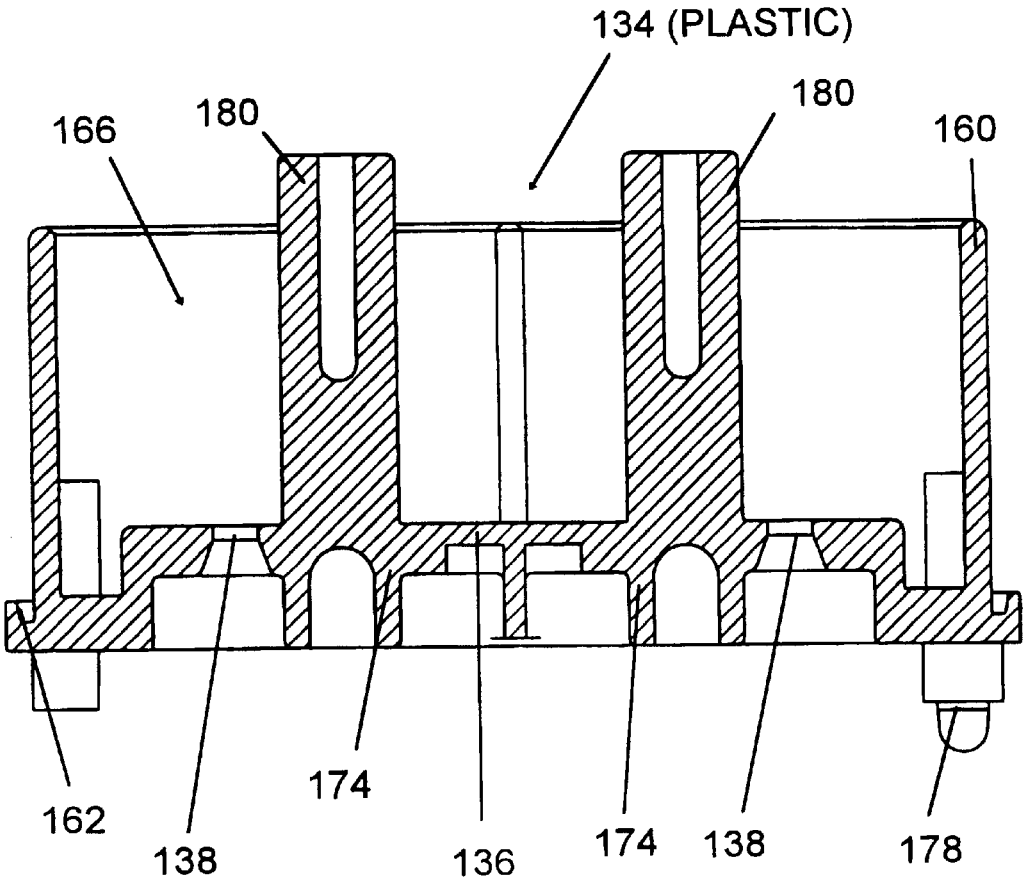
Figure 13:
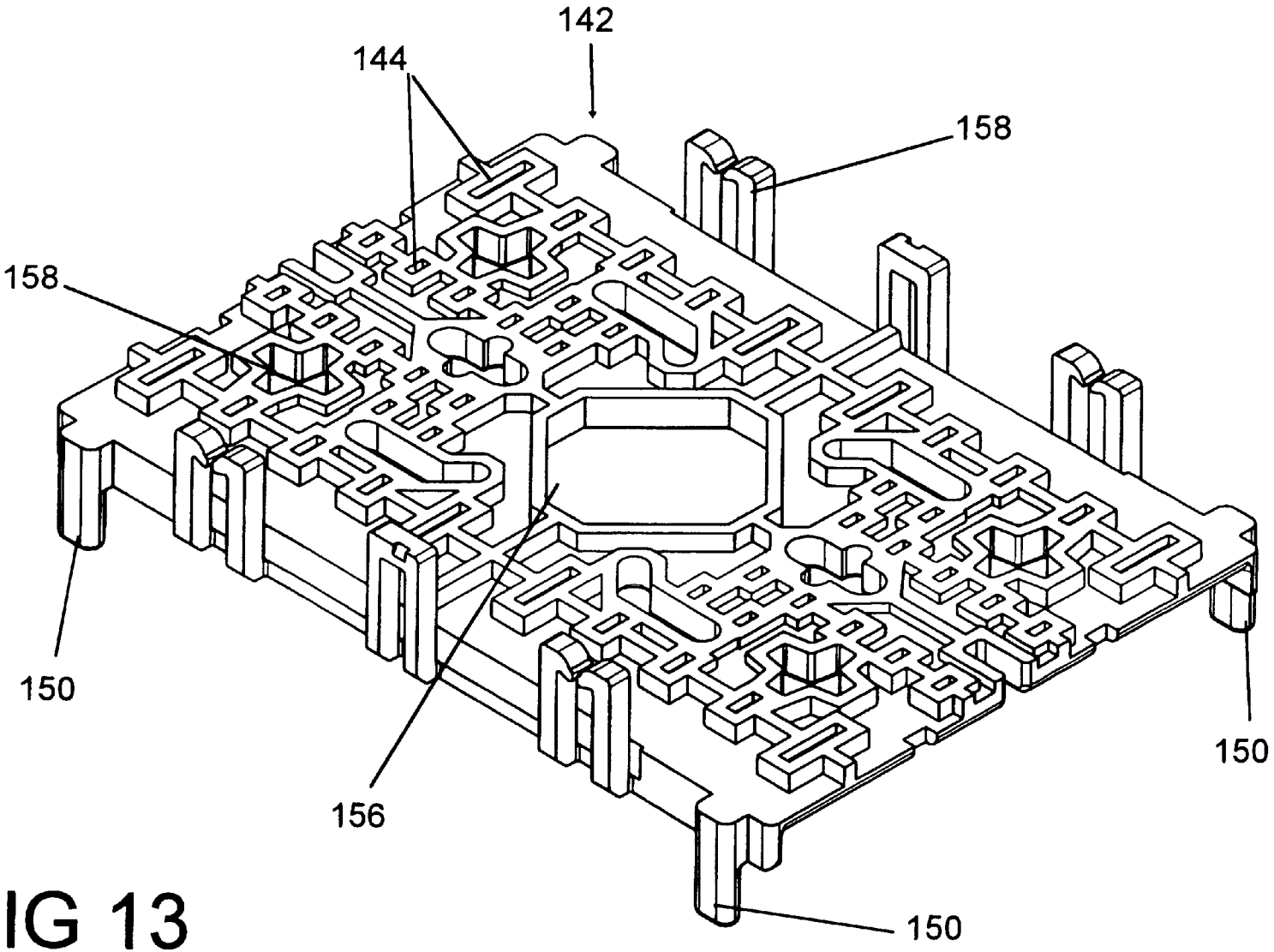
Figure 14:
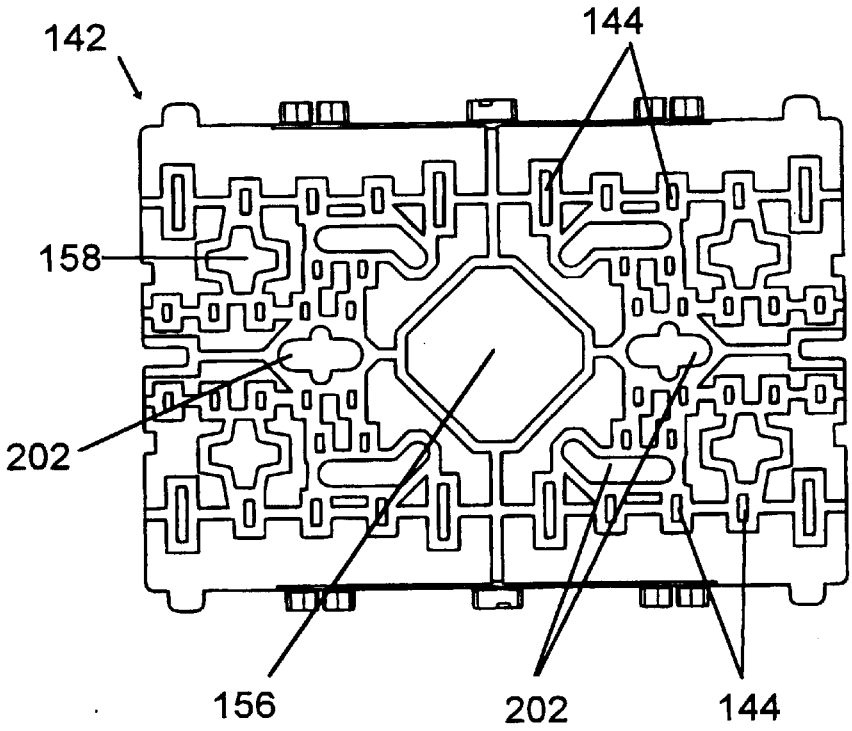
Figure 15:
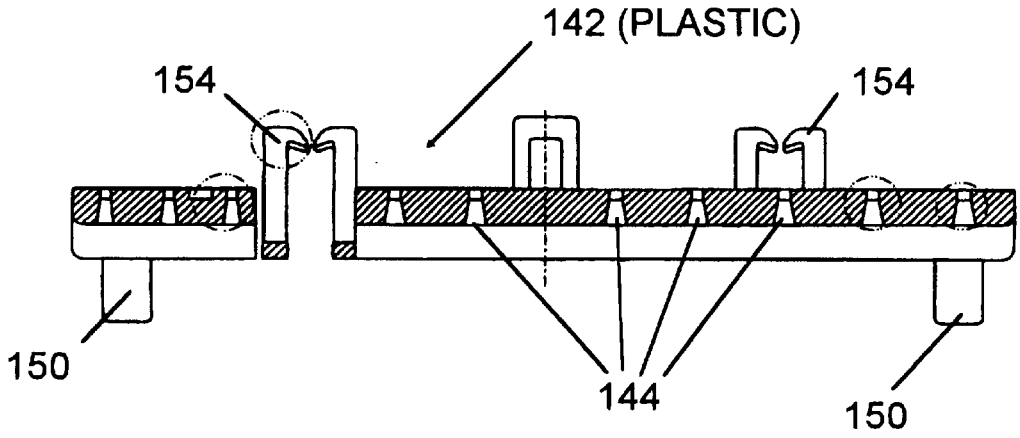
Figure 16:
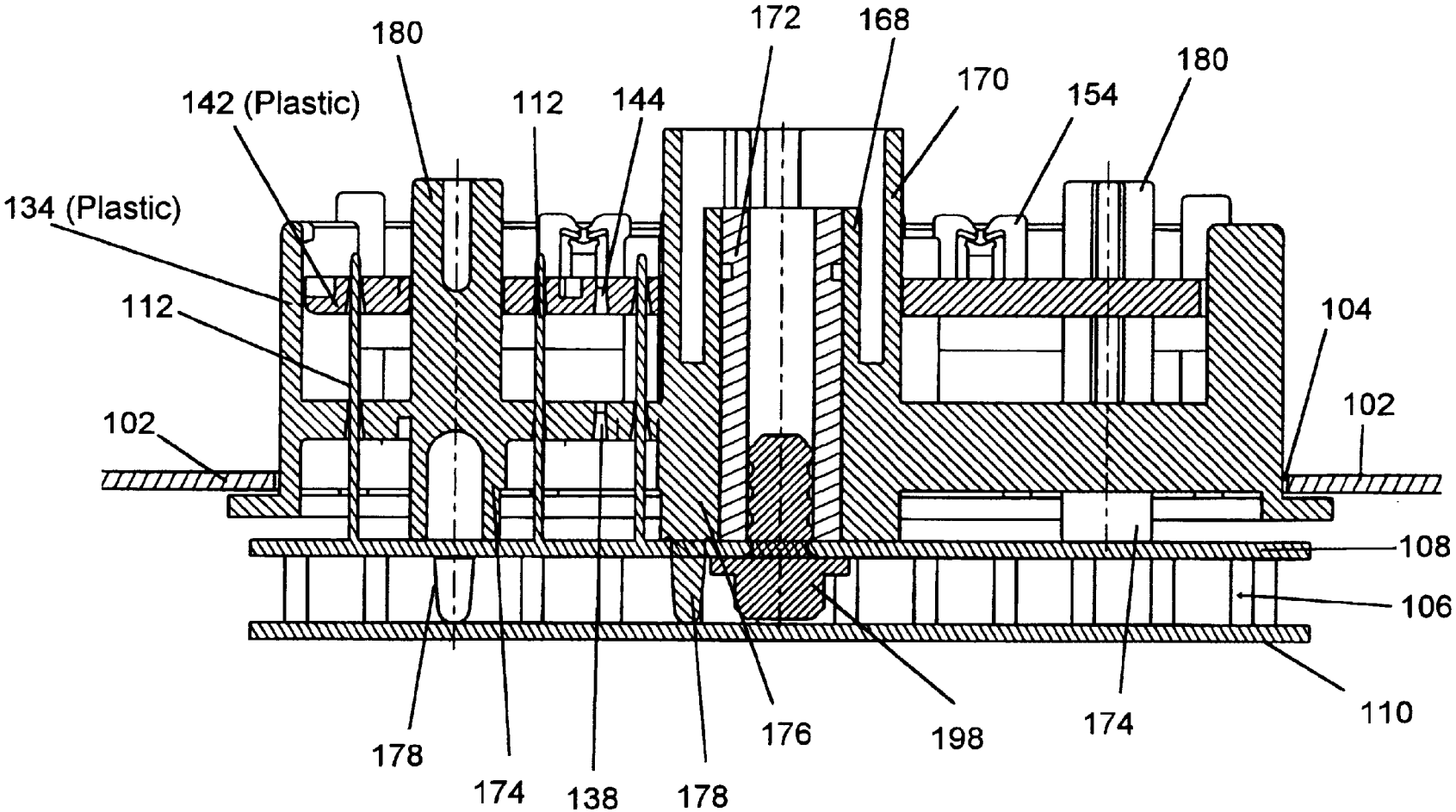
Figure 17:
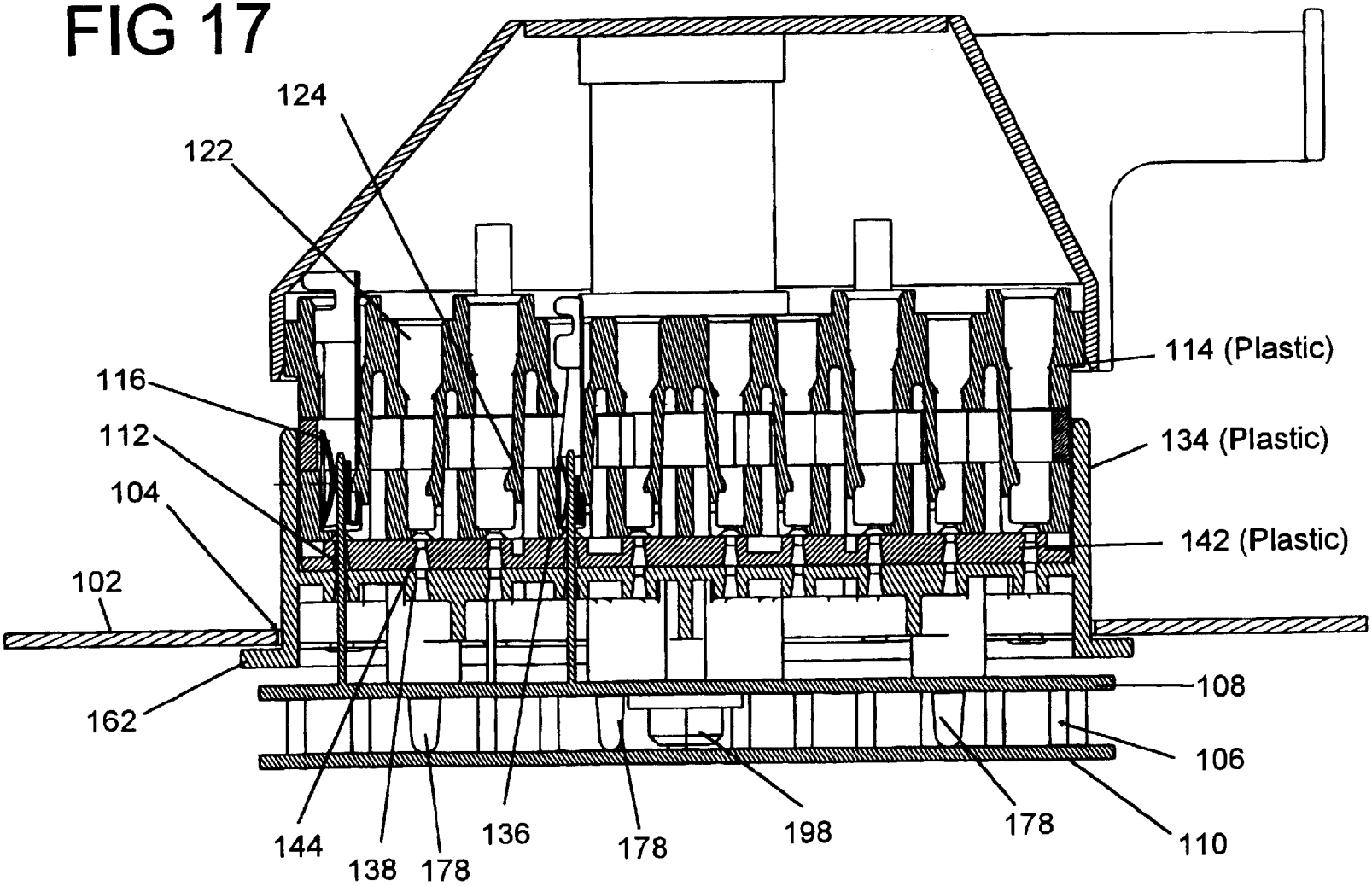

Details of the terminal position housing 134 are shown in FIGS. 11 and 12. Molded housing 134 has a base or stationary plate 136 with first apertures 138 for receiving printed circuit board blades 112 as shown in FIGS. 16 and 17. Outer housing walls 160 from a cavity 166. An outer mounting lip 162 extends around the housing 134 at the base of the shroud formed by the housing walls 160. As shown in FIGS. 16 and 17, this lip 160 fits beneath the bulkhead 102 as the terminal position housing 134 extends through the bulkhead opening 104.

Four alignment posts 180, having a cruciform cross section, extend upwardly from the stationary housing plate 136 in the same manner as the embodiment of FIGS. 1–10. As shown, housing 134 also includes six anti-scooping posts 200, which also extend upwardly from plate 136. Posts 200 have differing cross sections and are intended to prevent damage to terminal blades 112, which will surround posts 200. Damage could otherwise occur if an installer were to inadvertently attempt to insert the mating plug connector at an angle and scoop the terminal blades 112, thus causing damage. Anti-scooping posts 200 protect the blades 112 against that possibility. The anti-scooping posts and the alignment plate in the extended (unmated) position also serve to prevent damage to the terminal blades by tools or other equipment that might otherwise inadvertently strike the terminal blades.

The silo 168, extending upwardly from the center of the stationary plate 136 includes an outer skirt 170 that extends above the central portion of the silo containing a threaded member or nut 172 (threads not shown) that would engage a bolt extending from the mating plug connector. This skirt will not only prevent damage to the treaded member, but will also prevent wires or other items from snagging on the threads.

As shown in FIGS. 16 and 17, the terminal position housing 134 is positioned on the printed circuit board assembly 106, including two printed circuit boards 108 and 110 so that, with the stationary plate 136 spaced from the upper printed circuit board 108. In other words, a portion of the length of the blade 112 extends between the stationary plate 136 and the printed circuit board 108, so that the apertures 138 align the blades 112 at a location spaced from the printed circuit board 108 and the bottom of the blade 112. The terminal housing 134 includes four mounting posts 174 extending from the bottom of the stationary plate 136, as shown in FIGS. 12, 16 and 17. These mounting posts 174 are in substantial axial alignment with the alignment posts 180 extending from the top of the stationary plate 136, although such axial alignment is not necessary. A central support 176 is also located beneath the silo 168. Orienting keys 178 extend from the central support 176 and from the two out of four mounting posts 174 shown in FIG. 12. These keys 178 fit within holes in the upper printed circuit board 108 to align and key the terminal position housing to the printed circuit board assembly 106 to insure that the terminal position housing 134 is mounted in the proper orientation.

An alignment plate 142 that fits within the cavity 166 on terminal position housing 134 is shown in FIGS. 13–16. This alignment plate 142 is substantially the same as the alignment plate 42 shown in FIGS. 2–4. Alignment plate 142 includes an array of second apertures 144, aligned with stationary plate apertures 138; alignment post openings 158; a central opening 156 for the silo 168; guide posts 150, 152; and latching arms 154. Alignment plate 142 also includes four openings 202 for the anti-scooping posts 200.

FIGS. 16 and 17 show the manner in which the terminal position housing assembly is mounted on the printed circuit board assembly 106, and the manner in which the alignment plate 142 shifts as the plug connector 114 is mated to the printed circuit blades 112 with the assistance of the terminal position housing assembly. In this embodiment, the terminal position housing is bolted directly to the upper printed circuit board 108 by a mounting bolt 198 at the base of the central silo 168. The apertures 138 in the stationary plate 136 and the apertures 144 in the movable alignment plate 144 both laterally support and align the blades 112 at axially spaced positions as shown in FIG. 16. Plug connector 114 can then be mated to the printed circuit board blades 112 with the assistance of the terminal position housing 134 and the movable alignment plate 142 in substantially the same manner as for the embodiment of FIGS. 1–10. The plug connector 114, shown in FIG. 17, is substantially the same as the plug connector 14, and includes female terminals 116 located in terminal cavities 122 and held in position by terminal latches 124. Although not shown in FIG. 17, the plug connector 114 also includes alignment post openings for receiving the alignment posts 180, as well as openings for receiving the top guide posts 152 on the alignment plate 142. Plug connector 114 would similarly include openings for the anti-scooping posts 200 extending upwardly from the terminal position housing 134 so that the plug connector 114 can be fully mated.

The two representative embodiments depicted herein show only a single plug connector 14 or 114 mated to printed circuit board blades 12 or 112 with the assistance of a single terminal position housing 34 or 134 and one alignment plate 42 or 142. However, this approach is especially suitable for use in mating multiple plug connectors 14 or 114 to printed circuit board blades 12, 112. The use of multiple connectors will limit the amount of force needed to mate each individual plug connector and will further limit potential deformation of the bulkhead, the printed circuit board or the blade 12 or 112 during mating. Therefore the two embodiments depicted herein are merely representative or other similar embodiments. Although the preferred embodiments of this invention are used with printed circuit board terminals, it should also be understood that the terminal position housing and the alignment plates are not limited to such use. For example, this invention could be employed with an array of terminals that have been inserted into a mating electrical connector attached on the other side of the bulkhead. The terminal position housing assembly, of which the two embodiments depicted herein are representative, allows the terminals, especially male terminal pins or blades to be more precisely aligned or positioned then would be possible if only openings in a bulkhead were used. Therefore this invention is not limited to the embodiments shown herein, but is instead defined by the following claims.

We claim:

1. An apparatus for aligning an array of male terminals, the apparatus comprising: a stationary plate having a plurality of first apertures dimensioned to permit passage of male terminals through the first apertures without being secured thereto, and an alignment plate having a plurality of second apertures dimensioned to permit passage of male terminals through the second apertures without being secured thereto, said alignment plate being shiftable toward said stationary plate, the alignment plate being constrained relative to the stationary plate so that male terminals are progressively aligned when inserted through the first apertures and then through the second apertures.

2. The apparatus of claim 1 including means for mounting the stationary plate in a fixed position relative to the array of male terminals.

3. The apparatus of claim 2 wherein the stationary plate comprises a portion of a housing assembly, the housing assembly further including a fastener comprising means for securing an electrical connector to the housing assembly in a mated configuration.

4. The apparatus of claim 3 wherein the fastening means comprises a female treaded member positioned and sized to be engaged by a bolt on a mating electrical connector.

5. The apparatus of claim 4 wherein the female threaded member is surrounded by a silo extending upwardly from the stationary plate.

6. The apparatus of claim 5 wherein the silo is surrounded by a skirt extending upwardly beyond the silo.

7. The apparatus of claim 1 wherein a plurality of alignment posts extend upwardly from the stationary plate through the alignment plate to an exposed position.

8. The apparatus of claim 1 wherein outer walls extend upwardly from edges of the stationary plate to form a cavity.

9. The apparatus of claim 1 wherein the first apertures comprise rectangular apertures.

10. The apparatus of claim 1 further comprising means for mounting the apparatus on a bulkhead.

11. A terminal position housing assembly comprising a molded housing having a plurality of first apertures extending through a base and an alignment plate, shiftable relative to the molded housing, toward and away from the base, the alignment plate including a plurality of second apertures aligned with the first apertures, the base and the alignment plate comprising means for progressively aligning an array of male terminals when the male terminals are inserted through the first and second apertures without being secured thereto, whereby the male terminals are precisely positioned for mating with a corresponding array of female terminals.

12. The terminal position housing assembly of claim 11 including mounting posts extending downwardly from the base so that the base can be mounted in spaced relation to a printed circuit board containing said male terminals.

13. The terminal position housing assembly of claim 12 wherein selected ones of said mounting posts are provided with keys at a base portion of said mounting posts to properly orient the housing relative to a printed circuit board.

14. The terminal position housing assembly of claim 12 wherein alignment posts extend upwardly from the base of said housing and extend through the alignment plate, the alignment posts also comprising means for aligning a mating electrical connector relative to the housing.

15. The terminal position housing assembly of claim 14 wherein the alignment posts and the mounting posts have a common axis.

16. The terminal position housing assembly of claim 11 wherein the base comprises a plate.

17. The terminal position housing assembly of claim 11 wherein a shroud extends around the base forming a cavity on one side of the base, the alignment plate being positioned in the cavity.

18. The terminal position housing assembly of claim 17 wherein the alignment plate includes guide posts extending downwardly into guide openings on the base, the guide posts and the guide openings comprising means for maintaining alignment between the first and second apertures as the alignment plate shifts toward and away from said base.

19. The terminal position housing assembly of claim 18 wherein the alignment plate includes secondary guide posts extending upwardly therefrom.

20. The terminal position housing assembly of claim 11 wherein a silo extends upward from the housing base and a central support extends below the housing base in substantial alignment with the silo, the silo including a female threaded member for engagement with a bolt.

21. The terminal position housing assembly of claim 11 including means for mounting the housing on a bulkhead.

22. The terminal position housing assembly of claim 11 including means for mounting the housing base in parallel relationship to a printed circuit board.

23. The terminal position housing assembly of claim 11 wherein the first and second apertures each include a tapered lead in.

24. The terminal position housing assembly of claim 11 wherein the second apertures have a true position tolerance that is less than the true position tolerance of the first apertures so that the first apertures comprise means for positioning the male terminals in a position for insertion into aligned second apertures.

25. An electrical connector assembly comprising first and second mating electrical connectors, the first electrical connector including male terminals, a base plate and a shiftable alignment plate, the base plate and the alignment plate each having a plurality of apertures with the male terminals extending through the apertures without being connected thereto, the alignment plate also including guide posts extending toward a mating face of the first connector and toward a rear face of the first connector, the guide posts being located at the corners of the alignment plate, the second connector including openings for receiving guide posts extending toward the mating face of the first connector to stabilize the alignment plate as the first electrical connector is mated to the second electrical connector.

26. In combination, a terminal position housing and a mating electrical connector, said combination comprising a terminal position housing including means for mounting the housing on a bulkhead, the housing also including a plurality of first apertures in a housing base through which male terminals extend without being connected when the housing is mounted on a bulkhead, the housing also including a centrally positioned threaded member matable with a bolt in a mating electrical component when the mating electrical component is mated with the terminal position housing, the means for mounting the housing being spaced from the bolt to distribute forces to prevent deformation of a bulkhead as the bolt engages the threaded member.

27. The combination of claim 26 wherein the means for mounting the housing on a bulkhead comprise latch means located at spaced locations on the periphery of the housing.

28. The combination of claim 27 wherein the latch means comprise snap latches.

29. The combination of claim 28 wherein the snap latches comprise molded snap latches protruding from sides of the housing.

* * * * *